US010800191B2

(12) United States Patent
Nakamura et al.

(10) Patent No.: US 10,800,191 B2
(45) Date of Patent: Oct. 13, 2020

(54) IMAGE FORMING APPARATUS

(71) Applicant: KYOCERA Document Solutions Inc., Osaka (JP)

(72) Inventors: Satoru Nakamura, Osaka (JP); Toshinori Muraoka, Osaka (JP); Naoki Yamane, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/418,957

(22) Filed: May 21, 2019

(65) Prior Publication Data

US 2019/0358971 A1 Nov. 28, 2019

(30) Foreign Application Priority Data

May 28, 2018 (JP) ..... 2018-101456

(51) Int. Cl.
*B41J 11/14* (2006.01)
*B41J 25/308* (2006.01)

(52) U.S. Cl.
CPC ..... *B41J 11/14* (2013.01); *B41J 25/3088* (2013.01)

(58) Field of Classification Search
CPC ..... B41J 25/3088; B41J 11/20; B41J 11/14
USPC ..... 347/104
See application file for complete search history.

(56) References Cited

U.S. PATENT DOCUMENTS 4,273,323 A * 6/1981 Kaneko ..... B65H 1/18 271/126
7,887,178 B2 * 2/2011 Moon ..... B05B 13/0447 347/104
8,297,733 B2 * 10/2012 Tsuji ..... B41J 2/16547 347/29
2005/0275706 A1 * 12/2005 Takagi ..... B41J 2/16523 347/104
2010/0259580 A1 * 10/2010 Tsuji ..... B41J 2/16547 347/33
2014/0063092 A1 * 3/2014 Nakamura ..... B41J 25/308 347/8
2018/0265315 A1 * 9/2018 Doshida ..... B65H 1/12

FOREIGN PATENT DOCUMENTS

JP 2012192524 A 10/2012

* cited by examiner

*Primary Examiner* — Huan H Tran
*Assistant Examiner* — Alexander D Shenderov
(74) *Attorney, Agent, or Firm* — Studebaker & Brackett PC

(57) ABSTRACT

An image forming apparatus includes a head unit, a conveyance unit, a lifting and lowering mechanism, a drive source and a transmission mechanism. The head unit is provided with an inkjet head having a discharge opening through which an ink is discharged. The conveyance unit is supported in an upwardly and downwardly movable manner in directions close to and apart from the head unit from a lower side. The lifting and lowering mechanism is configured to lift and lower the conveyance unit. The drive source is configured to drive the lifting and lowering mechanism. The transmission mechanism is configured to transmit driving force from the drive source to the lifting and lowering mechanism. The transmission mechanism includes a warm gear, a warm wheel meshed with the warm gear and a resistance applying member configured to apply resistance to rotation of the warm gear.

4 Claims, 6 Drawing Sheets

IMAGE FORMING APPARATUS

INCORPORATION BY REFERENCE

This application is based on and claims the benefit of priority from Japanese Patent application No. 2018-101456, filed on May 28, 2018, which is incorporated by reference in its entirety.

BACKGROUND

The present disclosure relates to an inkjet type image forming apparatus.

An inkjet type image forming apparatus is provided with a head unit and a conveyance unit. The head unit includes an inkjet head having a discharge opening through which an ink is discharged. The conveyance unit is supported in an upwardly and downwardly movable manner in directions close to or apart from the head unit from the lower side.

As a mechanism to lift and lower the conveyance unit, the following lifting and lowering mechanism is known. The lifting and lowering mechanism includes a fixed pulley and a winding pulley which are provided in a casing to which the conveyance unit is supported, a movable pulley provided in the conveyance unit, a wire both ends of which are fixed to the casing and the winding pulley, in which the wire is put around the movable pulley and the fixed pulley, and a motor to rotate the winding pulley. When the motor rotates the winding pulley, the wire is wound or unwound around the winding pulley via the pullies to lift and lower the conveyance unit with respect to the casing.

In such a lifting and lowering mechanism, a worm gear and a worm wheel are sometimes disposed between the motor and the winding pulley. By a self-locking function of the worm gear and the worm wheel (a function that transmission of driving force from an output side (a side of the worm wheel) to an input side (a side of the worm gear) is interrupted during stopping of the motor), the conveyance unit is stopped at a lifted position and a lowered position.

The above self-locking function of the worm gear and the worm wheel have parameters including an angle of lead of the worm gear and a frictional coefficient between gear teeth of the worm gear and the worm wheel. The frictional coefficient may be varied depending on uncertain factors such as a surface condition of each gear. Then, the self-locking function is insufficient for positioning the conveyance unit correctly.

SUMMARY

In accordance with an aspect of the present disclosure, an image forming apparatus includes a head unit, a conveyance unit, a lifting and lowering mechanism, a drive source and a transmission mechanism. The head unit is provided with an inkjet head having a discharge opening through which an ink is discharged. The conveyance unit is supported in an upwardly and downwardly movable manner in directions close to and apart from the head unit from a lower side. The lifting and lowering mechanism is configured to lift and lower the conveyance unit. The drive source is configured to drive the lifting and lowering mechanism. The transmission mechanism is configured to transmit driving force from the drive source to the lifting and lowering mechanism. The transmission mechanism includes a work gear, a worm wheel meshed with the worm gear and a resistance applying member configured to apply resistance to rotation of the worm gear.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to one embodiment of the present disclosure will be described.

Figure 1:
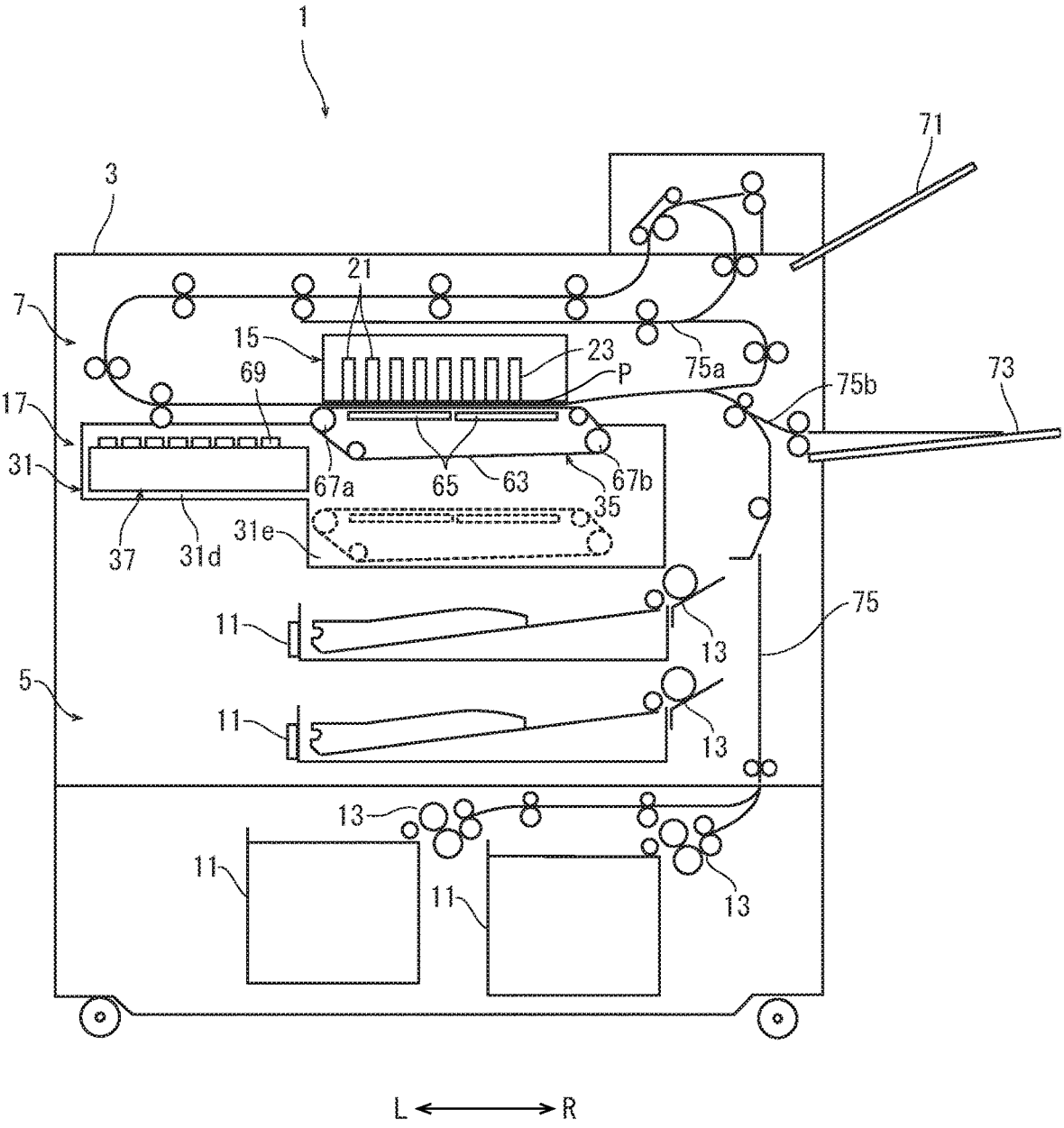
FIG. 1 is a front view schematically showing an inner structure of an image forming apparatus (at an image forming operation) according to an embodiment of the present disclosure.

With reference to FIG. 1, the image forming apparatus 1 will be described. FIG. 1 is a front view schematically showing an internal structure of the image forming apparatus (at an image forming operation). In the following description, a near side of a paper surface of FIG. 1 is defined to be a front side of the image forming apparatus 1. "Fr", "Rr", "U", "L" and "R" in each figure respectively indicate "a front side", "a rear side", "a left side" and "a right side" of the image forming apparatus.

An apparatus main body 3 of the image forming apparatus 1 is provided with a sheet feeding part 5 and an inkjet type image forming part 7. The sheet feeding part 5 is disposed in a lower portion in the apparatus main body 3, and includes a plurality of sheet feeding cassettes 11 storing sheets S and sheet feeding devices 13 feeding the sheet S from the respective sheet feeding cassettes 11. The image forming part 7 is disposed in an upper portion in the apparatus main body 3, and includes a head unit 15 and a processing unit 17 disposed below the head unit 15.

The head unit 15 includes four line heads 21 corresponding to inks of four colors (yellow, magenta, cyan and black). The four line heads 21 are disposed side by side in the left-and-right direction. Each of the line heads 21 includes three inkjet heads 23. The three inkjet heads 23 are aligned in zigzag in the front-and-rear direction, and connected to ink tanks storing the corresponding inks. The inkjet head 23 has a plurality of nozzles each having a discharge opening, and piezoelectric elements provided in the respective nozzles. The nozzles are supported with the discharge openings facing downward. When applied with voltage, the piezoelectric element is deformed to push out the ink in the nozzle and to discharge it through the discharge opening.

Figure 2:
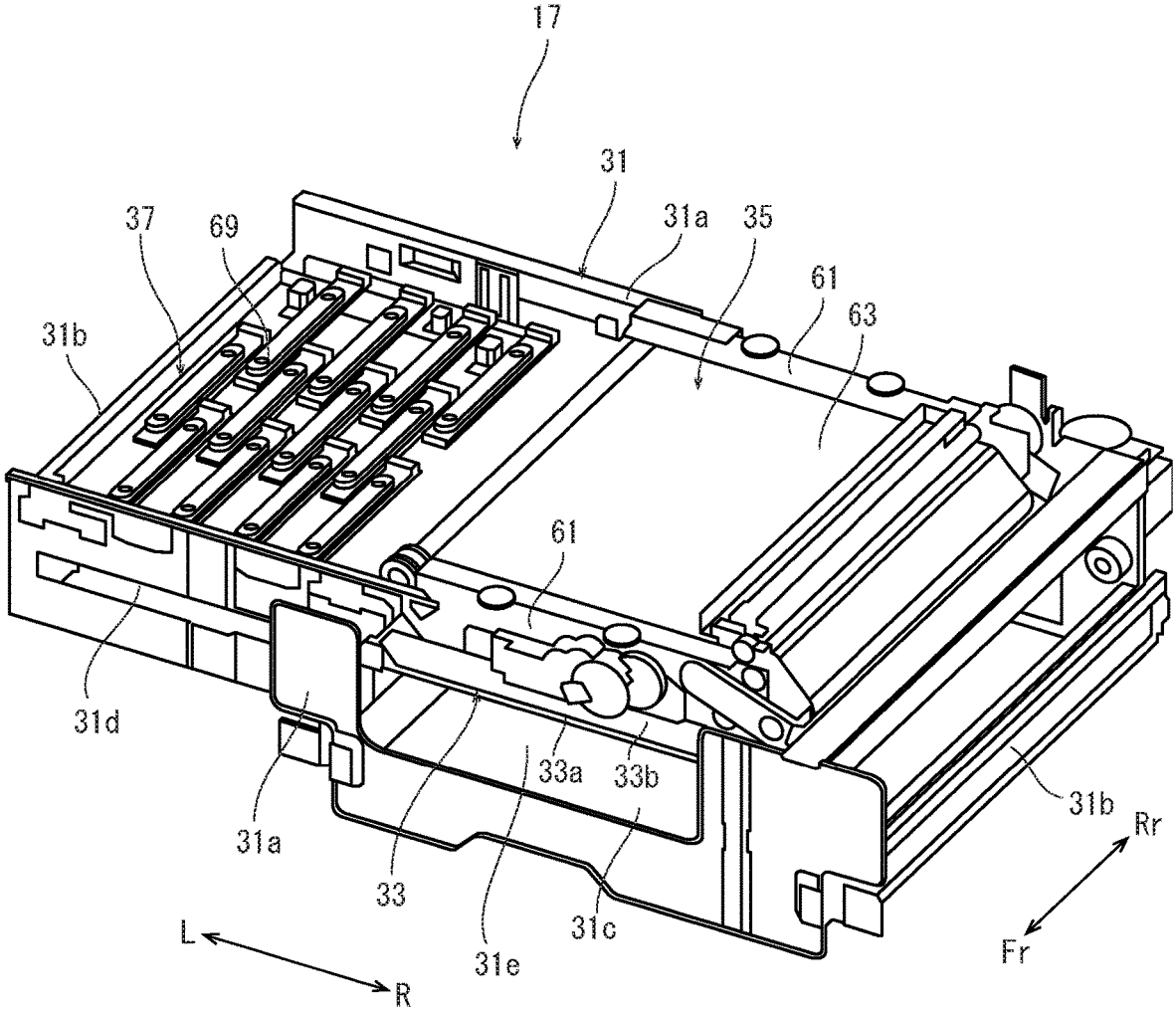
FIG. 2 is a perspective view showing a processing unit of the image forming apparatus according to the embodiment of the present disclosure.
Figure 4A:
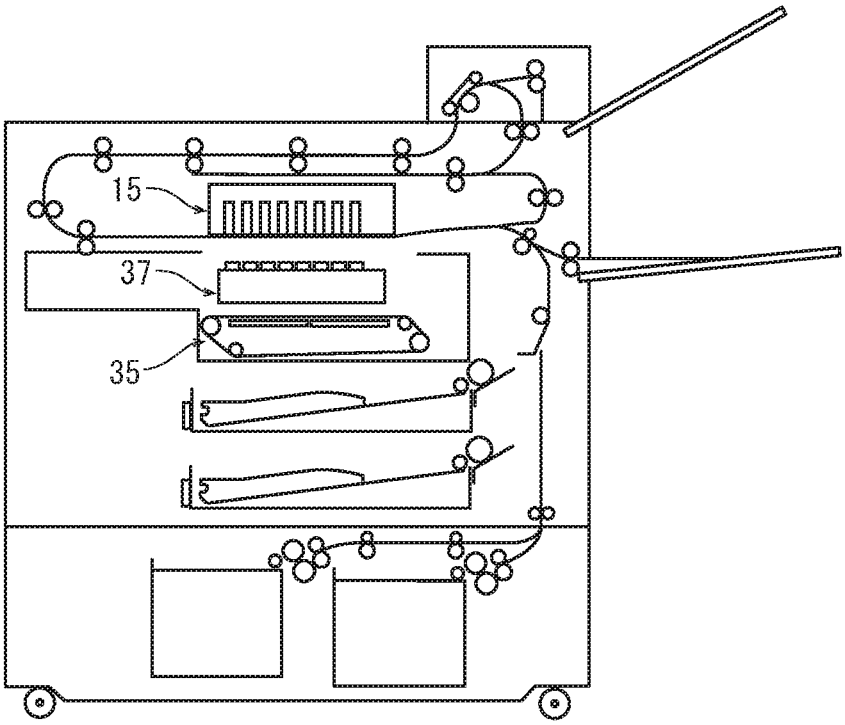
FIG. 4A is a front view schematically showing the inner structure of the image forming apparatus (at finishing of the image forming operation) according to the embodiment of the present disclosure.
Figure 4B:
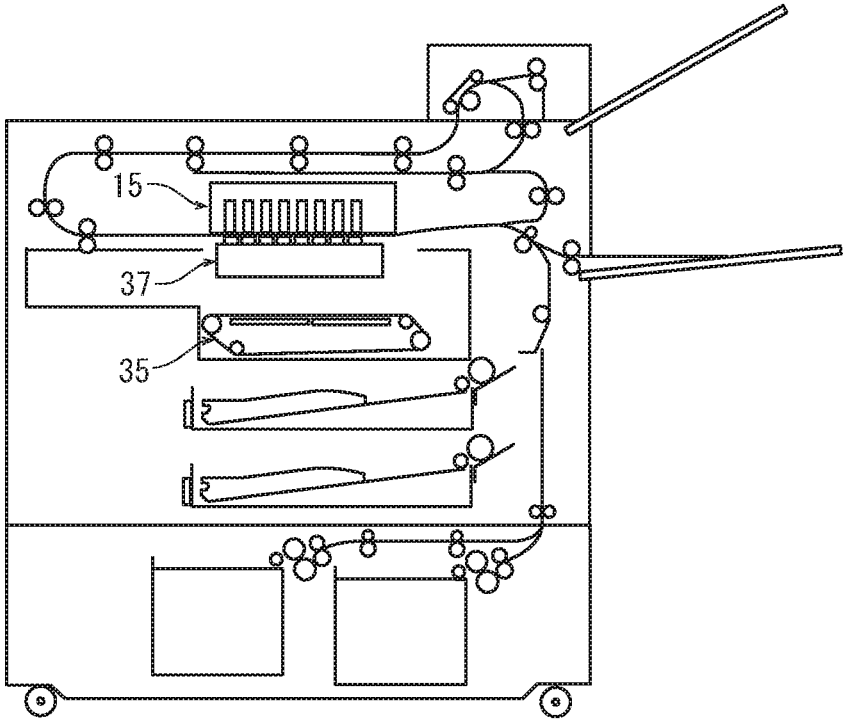
FIG. 4B is a front view schematically showing the inner structure of the image forming apparatus (at a treatment operation) according to the embodiment of the present disclosure.
Figure 5:
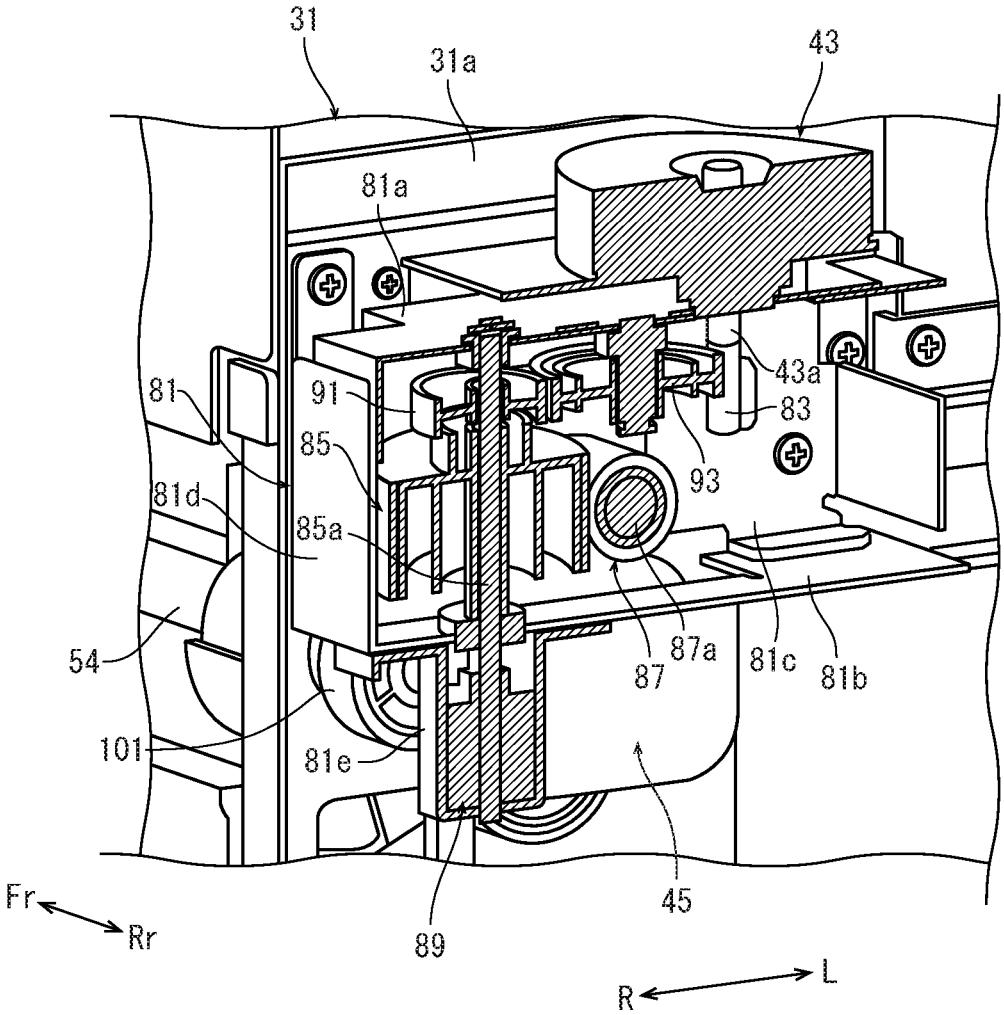
FIG. 5 is a partially cross sectional perspective view showing a driving part of a lifting and lowering mechanism, when viewed from a rear side, in the image forming apparatus according to the embodiment of the present disclosure.
Figure 6:
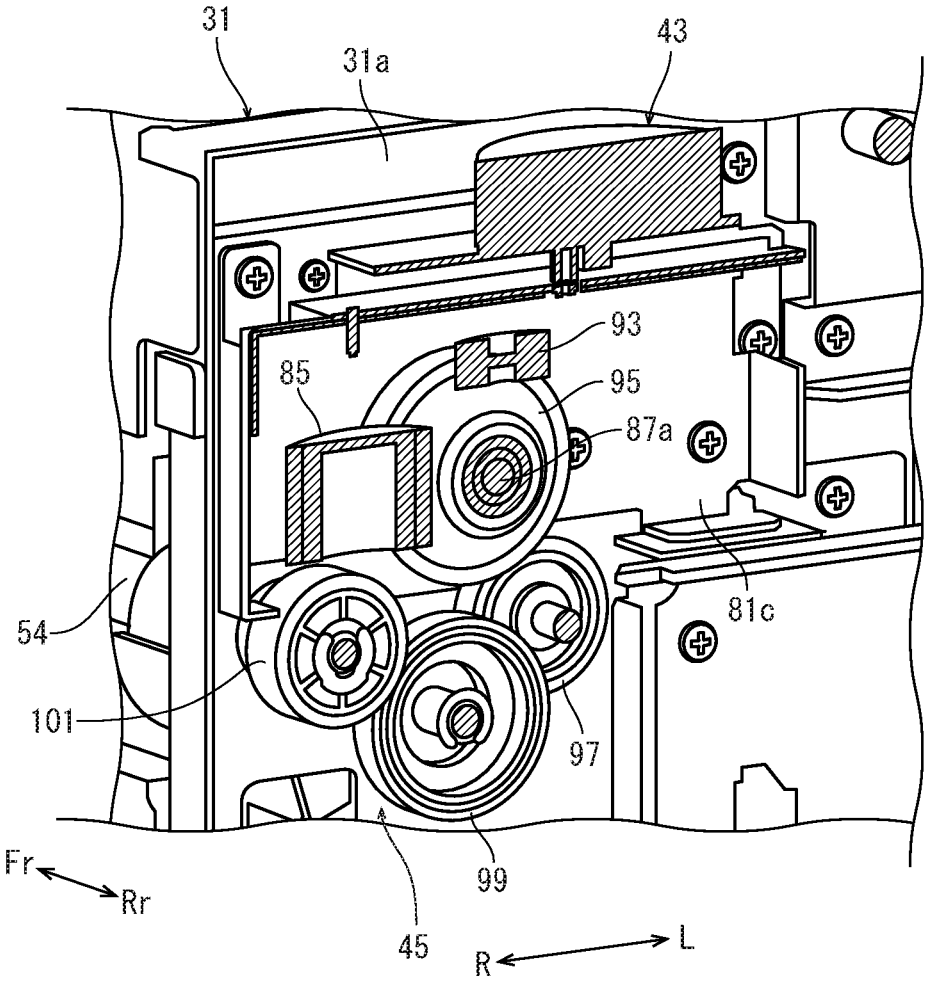
FIG. 6 is a perspective view showing the driving part of the lifting and lowering mechanism, when viewed from the rear side, in the image forming apparatus according to the embodiment of the present disclosure.

Next, the processing unit 17 will be described with reference to FIG. 1 to FIG. 6. FIG. 2 is a perspective view showing the processing unit, FIG. 3 is a front view schematically showing a positional relationship of each factor of a casing, a moving unit and a conveyance unit, FIG. 4A is a front view showing the processing unit at finishing of the image forming operation, FIG. 4B is a front view showing the processing unit at a treatment operation, and FIG. 5 and FIG. 6 are perspective views showing a drive source and a transmission mechanism.

As showing in FIG. 2, the processing unit 17 includes a casing 31, a moving unit 33 supported by the casing 31 in an upwardly and downwardly movable manner, a conveyance unit 35 placed on the moving unit 33 and a treatment unit 37 supported by the casing 31 in a movable manner in the left-and-right direction. The processing unit 17 further includes a lifting and lowering mechanism 41 (a front side lifting and lowering mechanism 41F and a rear side lifting and lowering mechanism 41R, refer to FIG. 3) to lift and lower the moving unit 33, a drive source 43 (refer to FIG. 5 and FIG. 6) configured to drive the lifting and lowering mechanism 41 and a transmission mechanism 45 (refer to FIG. 5 and FIG. 6) configured to transmit driving force from the drive source 43 to the lifting and lowering mechanism 41.

First, the casing 31 will be described. As shown in FIG. 2, the casing 31 is formed by front and rear side plates 31*a* facing each other in the front-and-rear direction, left and right side plates 31*b* facing each other in the left-and-right direction and a bottom plate 31*c*, and has a left storage part 31*d* and a right storage part 31*e* having a depth deeper than that of the left storage part 31*d*. As shown in FIG. 1, the processing unit 17 is disposed with the right storage part 31*e* of the casing 31 positioned below the head unit 15.

Figure 3:
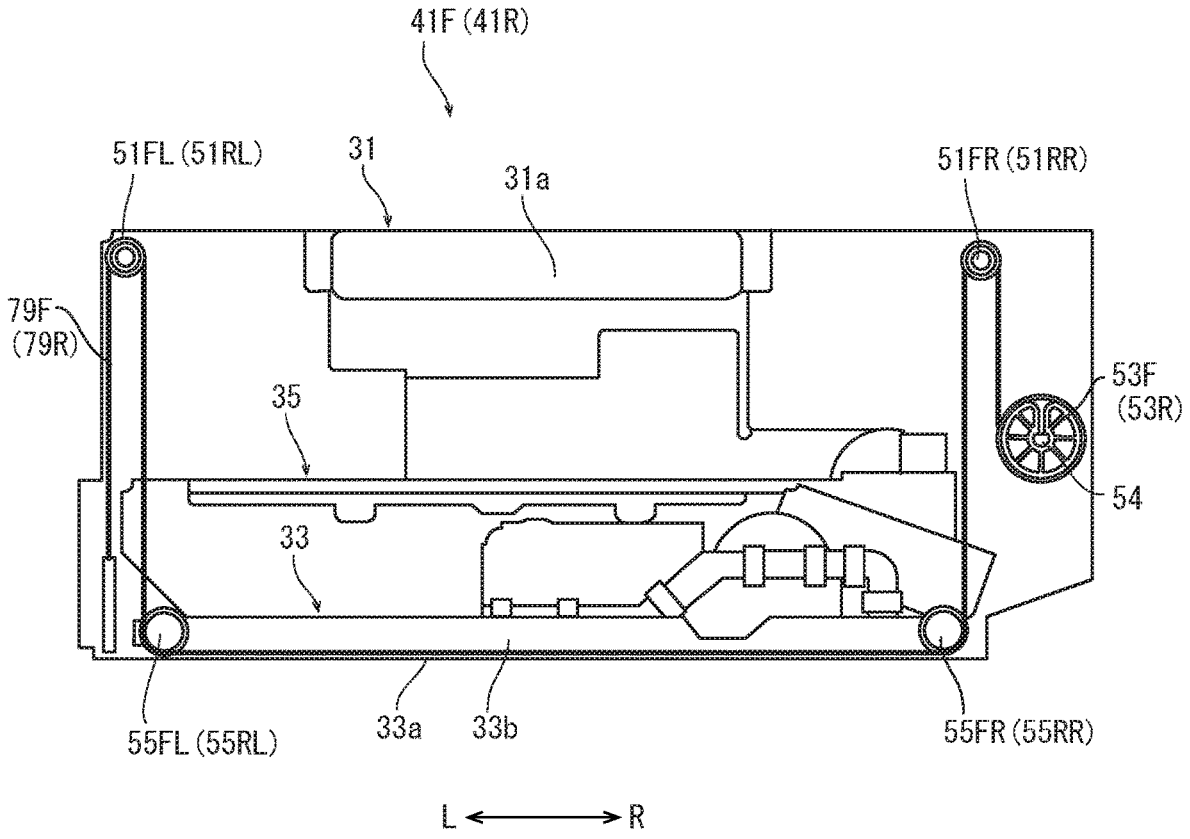
FIG. 3 is a front view schematically showing a positional relationship of each factor of a casing, a moving unit and a conveyance unit, in the image forming apparatus according to the embodiment of the present disclosure.

As shown in FIG. 3, on a rear face of the front side plate 31*a*, left and right front side fixed pulleys 51FL and 51FR are supported in a rotatable manner at the left upper corner portion and at the upper portion of the right end portion. On a front face of the rear side plate 31*a*, left and right rear side fixed pulleys 51RL and 51RR are supported in a rotatable manner at the left upper corner portion and at the upper portion of the right end portion.

On the rear face of the front side plate 31*a*, a front side winding pulley 53F is supported in a rotatable manner at the center portion in the upper-and-lower direction of the right end portion. On the front face of the rear side plate 31*a*, a rear side winding pulley 53R is supported in a rotatable manner at the center portion in the upper-and-lower direction of the right end portion. The front side winding pulley 53F and the rear side winding pulley 53R are respectively positioned outside (the right side) the right front side fixed pulley 51FR and the right rear side fixed pulley 51RR. The front and rear side winding pulleys 53F and 53R are fixed to a winding shaft 54. The winding shaft 54 is supported by the front and rear side plates 31*a* in a rotatable manner. A rear end portion of the winding shaft 54 penetrates rearward through the rear side plate 31*a*.

Next, the moving unit 33 will be described. As shown in FIG. 2, the moving unit 33 is formed by a rectangular bottom plate 33*a* having a size capable of being stored in the right storage part 31*e* of the casing 31, front and rear standing plates 33*b* bent upwardly from front and rear edges of the bottom plate 33*a*, and left and right standing plates (not shown) bent upwardly from left and right edges of the bottom plate 33*a*. In a center portion of the bottom plate 33*a*, a rectangular opening (not shown) is formed. The moving unit 33 is supported in the right storage part 31*e* of the casing 31 in an upwardly and downwardly moving manner.

As shown in FIG. 3, on a front face of the front standing plate 33*b*, left and right front side movable pulleys 55FL and 55FR are supported in a rotatable manner at the left and right lower corners. On a rear face of the rear standing plate 33*b*, left and right rear side movable pulleys 55RL and 55RR are supported in a rotatable manner at the left and right lower corners.

Next, the conveyance unit 35 will be described. As shown in FIG. 2, the conveyance unit 35 includes a pair of front and rear side plates 61, a conveyance belt 63 configured to be circulated and a suction device 65 (refer to FIG. 1). Between left end portions and right end portions of the front and rear side plates 61, a drive roller 67*a* and a driven roller 67*b* are supported in a rotatable manner, as shown in FIG. 1. The drive roller 67*a* is driven by a motor (not shown) to be rotated. The conveyance belt 63 is wound around the drive roller 67*a* and the driven roller 67*b*. When the drive roller 67*a* is driven by the motor to be rotated, the conveyance belt 63 is circulated in the counterclockwise direction in FIG. 1 and FIG. 2. An upper side track of the conveyance belt 63 is formed along the horizontal direction, and travels from the right side to the left side in FIG. 1 and FIG. 2. As shown in FIG. 1, the suction device 65 is disposed in a hollow space of the conveyance belt 63, and faces the upper side track of the conveyance belt 63. The suction device 65 generates a negative pressure in a space above the upper side track of the conveyance belt 63.

The conveyance unit 35 is placed on the bottom plate 33*a* of the moving unit 33. When the moving unit 33 is lifted (refer to a solid line in FIG. 1), the upper side track of the conveyance belt 63 of the conveyance unit 35 placed on the moving unit 33 is close to the discharge openings of the inkjet heads 23 of the head unit 15 to form an image forming path P (refer to FIG. 1) between the upper side track of the conveyance belt 63 and the discharge openings of the inkjet heads 23. On the other hand, when the moving unit 33 is lowered (refer to a chain line in FIG. 1), a predetermined space is formed between the conveyance unit 35 and the head unit 15.

The treatment unit 37 includes caps 69 corresponding to the inkjet heads 23 of the head unit 15. The cap 69 has an oval cylindrical shape having a size larger than that of the inkjet head 23.

The treatment unit 37 is supported in a movable manner in the left-and-right direction between the left storage part 31*d* and the right storage peat 31*e* of the casing 31. When the treatment unit 39 is moved from the left storage part 31*d* to the right storage part 31*e*, the caps 69 face the corresponding inkjet heads 23 of the head unit 15.

With reference to FIG. 1, on a right side face of the apparatus main body 3, a discharge tray 71 and a manual bypass tray 73 are provided. The discharge tray 71 is disposed in an upper end portion of the right side face and the manual bypass tray 73 is disposed below the discharge tray 71.

Inside the apparatus main body 3, a conveyance path 75 for the sheet S is formed. The conveyance path 75 is formed from the sheet feeding devices 13 of the sheet feeding part 5 to the discharge tray 71 through the image forming path P.

The conveyance path 75 has a switchback path 75*a* branched from a downstream side of the image forming path P and joined to an upstream side of the image forming path P in the conveyance direction. To the conveyance path 75, a manual bypass path 75*b* extending from the manual bypass tray 73 is joined at an upstream side of the joined portion of the switchback path 75*a* to the conveyance path 75.

Next, the image forming operation will be described with reference to FIG. 1, FIG. 4A and FIG. 4B.

At an image forming operation shown in FIG. 1, the conveyance unit 35 is lifted, and the image forming path P is formed between the upper side track of the conveyance belt 63 and the discharge openings of the inkjet heads 23. The treatment unit 37 is moved to the left storage part 31*d*.

First, the sheet is fed from the predetermined sheet feeding cassette 11 to the conveyance path 75 by the sheet feeding device 13. The fed sheet is conveyed to the image forming path P along the conveyance path 75. In the image forming path P, the suction device 65 of the conveyance unit 35 generates the negative pressure in the space above the upper sidetrack of the conveyance belt 63, and the sheet is conveyed while being sucked to the conveyance belt 63. Then, the ink is discharged from the discharge openings corresponding to an image data to form an image on the sheet. The sheet on which the image is formed is conveyed along the conveyance path 75 and then discharged on the discharge tray 71. When a duplex printing is performed, the sheet on one face of which the image is formed is conveyed to the switchback path 75*b* and is turned upside down. Then, after the image is formed on the other face of the sheet, the sheet is conveyed along the conveyance path 75 and then discharged on the discharge tray 71.

After the image forming operation is finished, as shown in FIG. 4A, the conveyance unit 35 is lowered and the treatment unit 37 is moved to the right storage part 31*e*. Then, as shown in FIG. 4B, the treatment unit 37 is moved upwardly and the inkjet heads 23 of the head unit 15 are covered with the corresponding caps 69 to prevent drying of the discharge openings of the nozzles.

Next, the lifting and lowering mechanism 41, the drive source 43 and the transmission mechanism 45 will be described with reference to FIG. 3, FIG. 5 and FIG. 6.

First, the lifting and lowering mechanism 41 will be described with reference to FIG. 3. The lifting and lowering mechanism 41 includes the front side lifting and lowering mechanism 41F and the rear side lifting and lowering mechanism 41R. The front side lifting and lowering mechanism 41F has a front side wire 79F. One end of the front side wire 79F is fixed to the left lower corner of the rear face of the front side plate 31*a* of the casing 31. The front side wire 79F is wound around the left front side fixed pulley 51FL, the left and right front side movable pulleys 55FL and 55FR and the right front side fixed pulley 51FR in the order. The other end of the front side wire 79F is fixed to the front side winding pulley 53F. The rear side lifting and lowering mechanism 41R has a rear side wire 79R. One end of the rear side wire 79R is fixed to the left lower corner of the front face of the rear side plate 31*a* of the casing 31. The rear side wire 79R is wound around the left rear side fixed pulley 51RL, the left and right rear side movable pulleys 55RL and 55RR and the right rear side fixed pulley 51RR in the order. The other end of the rear side wire 79R is fixed to the rear side winding pulley 53R.

When the winding shaft 54 is rotated in one direction and the other direction, the front and rear side wires 79F and 79R are wound or unwound around the front and rear side winding pulleys 53F and 53R via the fixed pulleys and the movable pulleys, and the moving unit 33 is lifted and lowered with respect to the casing 31.

Next, the drive source 43 and the transmission mechanism 45 will be described with reference to FIG. 5 and FIG. 6. The drive source 43 and the transmission mechanism 45 is supported by a gear case 81 provided on a rear face of the rear side plate 31*a* of the casing 31. The gear case 81 is a box-shaped member whose rear face and left face are opened, and formed by an upper plate 81*a*, a lower plate 81*b*, a bottom plate 81*c* and a right side plate 81*d*. The lower plate 81*b* is formed with a cylindrical storage part 81*e* protruding downward.

The drive source 43 is a motor producing rotational force. An output shaft 43*a* of the motor 43 penetrates through the upper plate 81*a* and protrudes into the gear case 81. To the output shaft 43*a*, an output gear 83 is fixed.

The transmission mechanism 45 includes a worm gear 85, a worm wheel 87 meshed with the worm gear 85 and a torque limiter 89 as a resistance applying member provided in the worm gear 85.

The worm gear 85 is stored in the gear case 81, and a rotating shaft 85*a* of the worm gear 85 is supported by the upper plate 81*a* and the lower plate 81*b* in a rotatable manner. To an upper end portion of the rotating shaft 85*a*, an input gear 91 is fixed. The input gear 91 is meshed with the output gear 83 of the motor 43 via an idle gear 93. Thereby, the rotational force is transmitted from the motor 43 to the worm gear 85. A lower end portion of the rotating shaft 85*a* penetrates through the lower plate 81*b* and protrudes into the storage part 81*e*.

The worm wheel 87 is stored in the gear case 81 and meshed with the worm gear 85. A rotating shaft 87*a* of the worm wheel 87 is supported by the bottom plate 81*c* in a rotatable manner. As shown in FIG. 6, to the rotating shaft 87*a*, an output gear 95 is fixed. The output gear 95 is meshed with a drive gear 101 fixed to the rear end portion of the winding shaft 54, via two idle gears 97 and 99.

The torque limiter 89 has an inner ring, a coil spring binding around an outer circumferential face of the inner ring tightly, an outer ring fitted onto the inner ring in a relatively rotatable manner and a lid member closing a gap between the inner ring and the outer ring. One end of the coil spring is free and the other end is engaged with the lid member.

The torque limiter 89 is stored in the storage part 81*e* of the gear case 81. Into the inner ring, the lower end portion of the rotating shaft 85*a* of the worm gear 85 is inserted and is prevented from being rotated with respect to the inner ring. The outer ring is prevented from being rotated with respect to the storage part 81*e*. When the inner ring is rotated with respect to the outer ring, that is, when the rotating shaft 85*a* of the worm gear 85 is rotated with respect to the gear case 81, a diameter of the coil spring is increased to produce a predetermined torque.

In the image forming apparatus 1 having the above configuration, a lifting and lowering operation of the conveyance unit 35 (the moving unit 33) by the lifting and lowering mechanism 41 will be described with reference to FIG. 3, FIG. 5 and FIG. 6. When the conveyance unit 35 is lifted, the motor 43 is driven to rotate the output shaft 43*a* in the one direction. The rotation of the output shaft 43*a* is transmitted to the input gear 91 of the worm gear 85 via the idle gear 93 and rotates the worm gear 85. At this time, the torque limiter 89 applies resistance to the rotation of the rotating shaft 85*a* of the worm gear 85. That is, the inner ring prevented from being rotated with respect to the rotating shaft 85*a* is rotated with respect to the outer ring prevented from being rotated with respect to the storage part 81*e* of the gear case 81, and the diameter of the spring is increased to produce the predetermined torque.

When the worm gear 85 is rotated, the worm wheel 87 meshed with the worm gear 85 is rotated. The rotation of the worm wheel 87 is transmitted from the output gear 95 to the drive gear 101 via the two idle gears 97 and 99 to rotate the drive gear 101. Thereby, the winding shaft 54 is rotated in the one direction, and the front and rear side wires 79F and 79R are wound around the front and rear side winding pulleys 53F and 53R via the movable pulleys of the moving unit 33 and the fixed pulleys of the casing 31. Then, the moving unit 33 is moved upwardly to lift the conveyance unit 35. When the conveyance unit 35 is lowered, the motor 43 is driven to rotate the output shaft 43*a* in the other direction. At the lowering operation, the torque limiter 89 applies the resistance to the rotating shaft of the worm gear 85.

As described above, according to the image forming apparatus 1 of the present disclosure, because the torque limiter 89 applies the resistance to the rotation of the worm gear 85, it becomes possible to exhibit the self-locking function surely regardless of the unevenness of the frictional coefficient of the worm gear 85 and the worm wheel 87. Accordingly, it becomes possible to position the conveyance unit 35 with a high positional precision. Employing the torque limiter 89 makes a configuration to apply the resistance to the rotating shaft of the worm gear 85 simple. Additionally, even if the torque limiter 89 may be provided in the worm wheel 87, a predetermined effect can be obtained. However, if the torque limiter 89 is provided in the worm wheel 87, because a size in the front-and-rear direction is increased under the present configuration, the torque limiter 89 is preferably provided in the worm gear 85.

In the present embodiment, the torque limiter 89 is employed as the resistance applying member; however, a rotary oil damper or the like may be employed as the resistance applying member.

In the present embodiment, as the lifting and lowering mechanism 41, a configuration in which the wire is wound and unwound around the winding pulley via the movable pulley and the fixed pulley is employed. However, the lifting and lowering mechanism 41 is not limited to the configuration. For example, the moving unit 33 may be provided with a rack and the casing 31 may be provided with a pinion gear meshed with the rack. The pinion gear is driven by a motor to move the moving unit 33 upwardly and downwardly with respect to the casing 31. In the configuration, a transmission mechanism to transmit rotational force from the motor to the pinion gear is made to have the worm gear, the worm wheel and the torque limiter of the present embodiment.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. An image forming apparatus comprising:

a head unit provided with an inkjet head having a discharge opening through which an ink is discharged;

a conveyance unit supported in an upwardly and downwardly movable manner in directions close to and apart from the head unit from a lower side;

a lifting and lowering mechanism configured to lift and lower the conveyance unit;

a drive source configured to drive the lifting and lowering mechanism; and a transmission mechanism configured to transmit driving force from the drive source to the lifting and lowering mechanism, wherein the transmission mechanism includes a worm gear, a worm wheel meshed with the worm gear and a resistance applying member configured to apply resistance to rotation of the worm gear, wherein the lifting and lowering mechanism includes:

a fixed pulley and a winding pulley which are provided in a casing to which the conveyance unit is supported;

a movable pulley provided in a moving unit on which the conveyance unit is placed; and a wire configured to be wound around the fixed pulley and the movable pulley, one end of the wire being fixed to the casing and the other end of the wire being fixed to the winding pulley, the drive source includes a motor configured to generate rotating force, wherein the transmission mechanism transmits the rotating force from the motor to the winding pulley, the winding pulley is rotated to wind and unwind the wire via the fixed pulley and the movable pulley, and the conveyance unit placed on the moving unit is lifted and lowered with respect to the casing.

2. The image forming apparatus according to claim 1, wherein the casing includes a bottom plate, a front side plate and a rear side plate, the fixed pulley is one of a plurality of fixed pulleys provided at near left and right upper corners of the front side plate and the rear side plate, the moving unit includes a bottom plate, a front standing plate and a rear standing plate which are bent upwardly from a front edge and a rear edge of the bottom plate respectively, and the movable pulley is one of a plurality of movable pulleys provided at near left and right lower corners of the front standing plate and the rear standing plate.

3. An image forming apparatus comprising:

a head unit provided with an inkjet head having a discharge opening through which an ink is discharged;

a conveyance unit supported in an upwardly and downwardly movable manner in directions close to and apart from the head unit from a lower side;

a lifting and lowering mechanism configured to lift and lower the conveyance unit;

a drive source configured to drive the lifting and lowering mechanism; and a transmission mechanism configured to transmit driving force from the drive source to the lifting and lowering mechanism, wherein the transmission mechanism includes a worm gear, a worm wheel meshed with the worm gear and a resistance applying member configured to apply resistance to rotation of the worm gear, wherein the resistance applying member is a torque limiter provided in a rotating shaft of the worm gear.

4. The image forming apparatus according to claim 3, wherein the rotating shaft of the worm gear is along the upper-and-lower direction.

* * * * *